US009705194B2

(12) United States Patent
Kato et al.

(10) Patent No.: US 9,705,194 B2
(45) Date of Patent: Jul. 11, 2017

(54) ANTENNA MODULE

(75) Inventors: Noboru Kato, Nagaokakyo (JP); Jun Sasaki, Nagaokakyo (JP); Satoshi Ishino, Nagaokakyo (JP); Katsumi Taniguchi, Nagaokakyo (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 493 days.

(21) Appl. No.: 13/368,358

(22) Filed: Feb. 8, 2012

(65) Prior Publication Data

US 2013/0038501 A1 Feb. 14, 2013

Related U.S. Application Data

(63) Continuation of application No. PCT/JP2010/064041, filed on Aug. 20, 2010.

(30) Foreign Application Priority Data

Aug. 20, 2009 (JP) ..... 2009-190898

(51) Int. Cl.
*H01Q 9/04* (2006.01)

(52) U.S. Cl.
CPC ..... *H01Q 9/0407* (2013.01)

(58) Field of Classification Search
CPC ... H04B 1/38; H01P 7/082; H01P 7/10; H01P 3/082; H01P 3/088; H01P 3/006; H01Q 9/0407; H01Q 13/206
USPC ..... 343/860, 720, 862, 852, 700 MS, 850, 343/794, 795, 895, 725; 333/32, 33
See application file for complete search history.

(56) References Cited

U.S. PATENT DOCUMENTS 5,233,360 A * 8/1993 Kuroda et al. ..... 343/700 MS
5,258,728 A * 11/1993 Taniyoshi et al. ..... 333/132
5,701,128 A 12/1997 Okada et al.
(Continued)

FOREIGN PATENT DOCUMENTS

JP 08-242117 A 9/1996
JP 11-234033 A 8/1999
(Continued)

OTHER PUBLICATIONS

Official Communication issued in International Patent Application No. PCT/JP2010/064041, mailed on Nov. 22, 2010.

*Primary Examiner* — Dameon E Levi
*Assistant Examiner* — Hasan Islam
(74) *Attorney, Agent, or Firm* — Keating & Bennett, LLP

(57) ABSTRACT

In an antenna module, a main portion includes a plurality of insulating sheets made of a flexible material and laminated on each other. An antenna configured to transmit/receive a high-frequency signal is disposed in the main portion. A connection portion is disposed in the main portion and is connected to an electronic device that inputs/outputs the high-frequency signal. A signal transmission line is disposed in the main portion and has a strip line structure or a microstrip line structure to transmit the high-frequency signal. An impedance matching circuit is disposed in the main portion and between the antenna and end of a signal transmission line facing in a negative x direction. An impedance matching circuit is disposed in the main portion and between the connection portion and an end of the signal transmission line facing in a positive x direction.

7 Claims, 6 Drawing Sheets

(56) References Cited

U.S. PATENT DOCUMENTS

| | | | | |
|---|---|---|---|---|
| 5,760,746 | A * | 6/1998 | Kawahata | H01Q 1/38 343/700 MS |
| 5,903,239 | A * | 5/1999 | Takahashi | H01Q 1/22 333/247 |
| 6,215,454 | B1 * | 4/2001 | Tran | 343/841 |
| 2002/0044092 | A1 | 4/2002 | Kushihi | |
| 2002/0118075 | A1 * | 8/2002 | Ohwada et al. | 333/32 |
| 2005/0200557 | A1 * | 9/2005 | Tanaka et al. | 343/904 |
| 2006/0267844 | A1 * | 11/2006 | Yanagi | H01P 1/203 343/700 MS |
| 2008/0117117 | A1 * | 5/2008 | Washiro | H01Q 1/2225 343/850 |
| 2009/0002130 | A1 * | 1/2009 | Kato | G06K 19/07749 340/10.1 |
| 2009/0135087 | A1 * | 5/2009 | Gummalla | H01P 3/02 343/909 |
| 2010/0328188 | A1 * | 12/2010 | Chang et al. | 343/893 |

FOREIGN PATENT DOCUMENTS

| | | | |
|---|---|---|---|
| JP | 2002-076750 | A | 3/2002 |
| JP | 2002-314301 | A | 10/2002 |
| JP | 2006-121633 | A | 5/2006 |
| JP | 2007-235215 | A | 9/2007 |

* cited by examiner 37
50a
50b
C1
52a
52b
L1
t3
t4
44
b10
40
T1
T2
46
b9
22a
40b
t2
t1
38
26
b4
40a
22a
22b
22c
b6
b5
b4
b9
b10
48
A3
20a
20b
20c
16a
16b
16c
A2
24
26
12
28
30
b1
b2
b3
b7
b8
z
x
y
14
14a
14b
14c
34
32
36
31
P1
A1
18a
18b
18c

ANTENNA MODULE

BACKGROUND OF THE INVENTION

1. Field of the Invention

The present invention relates to an antenna module, and more particularly, to an antenna module including an antenna configured to transmit/receive a high-frequency signal.

2. Description of the Related Art

An example of an antenna module is a strip line cable integrated with an antenna (hereinafter also referred to simply as a strip line cable). A specific example of such a strip line cable is disclosed in Japanese Unexamined Patent Application Publication No. 8-242117. FIG. 6 is a perspective view illustrating an external appearance of a strip line cable 500 disclosed in Japanese Unexamined Patent Application Publication No. 8-242117.

As shown in FIG. 6, the strip line cable 500 includes insulators 510 and 512, a center conductor 514, conductors 516 and 518, and an impedance matching circuit 520. The strip line cable 500 has three regions including an antenna part 502, a transmission line part 504, and a counterpoise part 506.

The insulators 510 and 512 are formed of a flexible material. The conductor 516 is disposed on a lower surface of the insulator 510. The conductor 518 is disposed on an upper surface of the insulator 512. The center conductor 514 is a line-shaped conductor disposed on an upper surface of the insulator 510 such that the center conductor 514 extends in a longitudinal direction of the insulator 510. The insulator 510 and the insulator 512 are bonded together such that the upper surface of the insulator 510 is in contact with the lower surface of the insulator 512.

Note that the insulator 510 and the insulator 512 are not bonded together over their entire regions, but an end region with a length equal to approximately one-fourth the wavelength of the high-frequency signal of each insulator is not bonded. Hereafter, this end region where the insulator 510 and the insulator 512 are not bonded together is also referred to simply as the end region. More specifically, the end region of the insulator 512 extends in a direction perpendicular to the insulator 510. In the end region of the insulator 510, the insulator 510, the center conductor 514, and the conductor 516, in this end region, form the antenna part 502 such that a high-frequency signal is transmitted or received from or by the center conductor 514 in the antenna part 502. The insulator 512 and the conductor 518 in the end region form the counterpoise part 506.

In the region other than the end region, the insulators 510 and 512, the center conductor 514, the conductors 516 and 518, and the impedance matching circuit 520 form the transmission line part 504. In the transmission line part 504, the center conductor 514 and the conductors 516 and 518 form a strip line.

The impedance matching circuit 520 is disposed in the middle of the center conductor 514. The impedance matching circuit 520 has a line width greater than the line width of the center conductor 514. The impedance matching circuit 520 formed in this manner provides impedance matching between the antenna part 502 and the strip line of the transmission line part 504.

The strip line cable 500 disclosed in Japanese Unexamined Patent Application Publication No. 8-242117 has the following problem. That is, it is difficult to design the strip line cable 500 such that the transmission line part 504 is capable of being bent with a small radius while maintaining stability of the characteristic impedance without resulting in an increase in DC resistance. The strip line cable 500 may be used, for example, in a portable telephone. In recent years, the size of the portable telephone has become increasingly small. As a result, the space for installing the strip line cable 500 in the portable telephone has increasingly become narrow. Thus, there is a need for a transmission line part capable of being bent with as small a radius as possible. A method for satisfying the above need may be, for example, to reduce the thickness of the insulators 510 and 512 to reduce the rigidity of the strip line cable 500, which makes it possible to bend the transmission line part 504 with a small radius.

However, in the strip line cable 500, the reduction in the thickness of the insulators 510 and 512 results in a reduction in the distance between the center conductor 514 and the conductors 516 and 518, which leads to an increase in capacitance between the center conductor 514 and the conductors 516 and 518. This causes a shift in the characteristic impedance (for example, 50 ohms or 75 ohms) of the strip line of the transmission line part 504. To prevent the shift in the characteristic impedance, it is necessary to reduce the line width of the center conductor 514 to reduce the capacitance between the center conductor 514 and the conductors 516 and 518. However, the reduction in line width of the center conductor 514 results in an increase in DC resistance of the strip line cable 500. As described above, in the technique disclosed in Japanese Unexamined Patent Application Publication No. 8-242117, it is difficult to design the strip line cable 500 such that the transmission line part 504 is capable of being bent with a small radius while maintaining stability of the characteristic impedance and without resulting in an increase in the DC resistance.

SUMMARY OF THE INVENTION

In view of the above, preferred embodiments of the present invention provide an antenna module configured such that a signal transmission line is capable of being bent with a small radius while maintaining stability of the characteristic impedance without causing an increase in DC resistance.

According to a preferred embodiment of the present invention, an antenna module includes a main portion including a lamination of a plurality of flexible insulating sheets, an antenna disposed on the main portion and configured to transmit/receive a high-frequency signal, a connection portion disposed on the main portion and configured to be connected to an electronic device that outputs/inputs the high-frequency signal, a signal transmission line configured to transmit the high-frequency signal, the signal transmission line being disposed in the main portion and having a strip line structure or a microstrip line structure, a first impedance matching circuit disposed in the main portion and between the antenna and one end of the signal transmission line, and a second impedance matching circuit disposed in the main portion and between the connection portion and the other end of the signal transmission line.

In the antenna module according to a preferred embodiment of the present invention, the signal transmission line is capable of being bent with a small radius while maintaining the stability of the characteristic impedance without resulting in an increase in DC resistance.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

An antenna module according to preferred embodiments of the present invention is described below with reference to the accompanying drawings.

Figure 1:
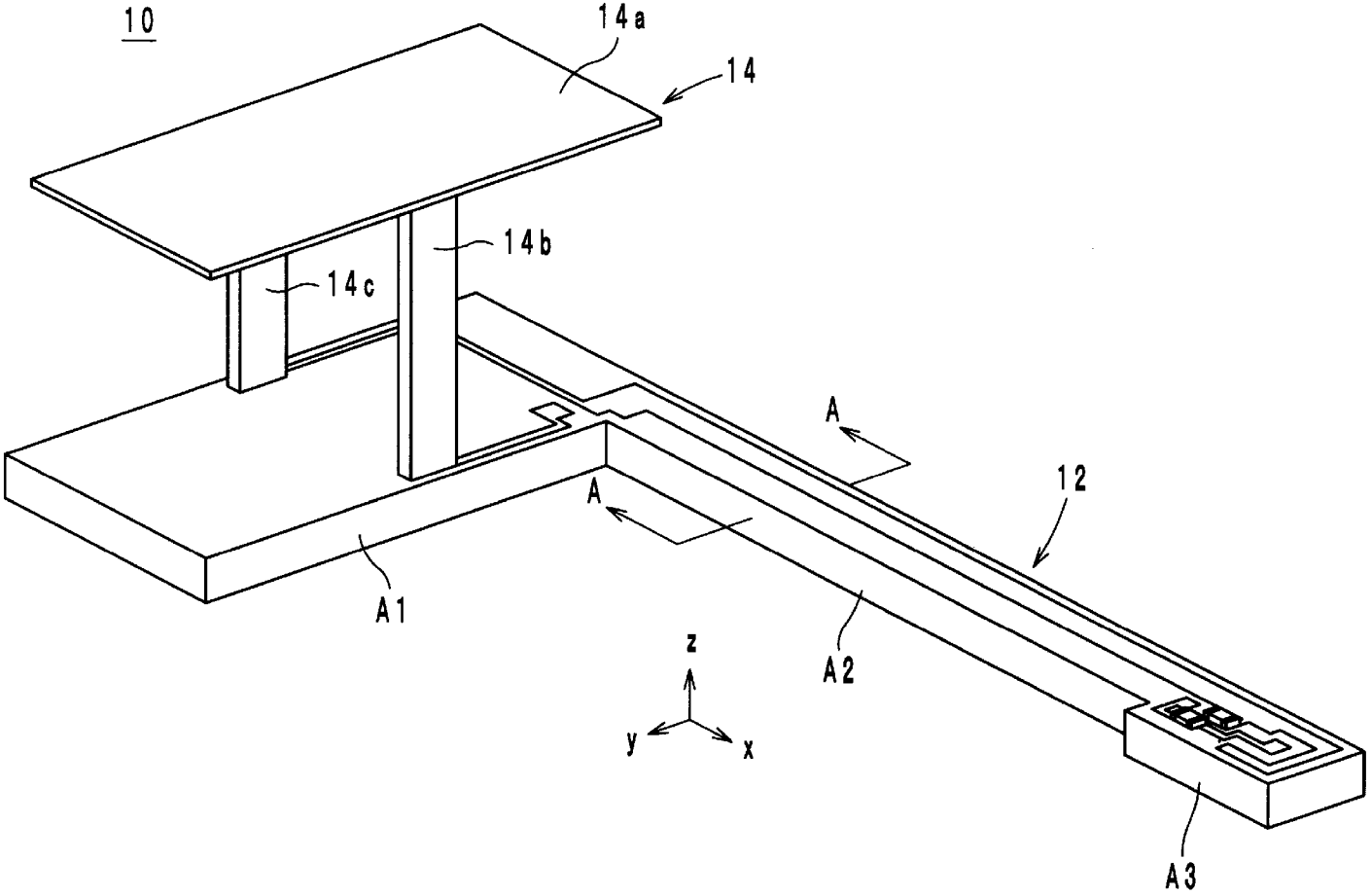
FIG. 1 is a perspective view illustrating an external appearance of an antenna module according to a preferred embodiment of the present invention.
Figures 2A, 2B:
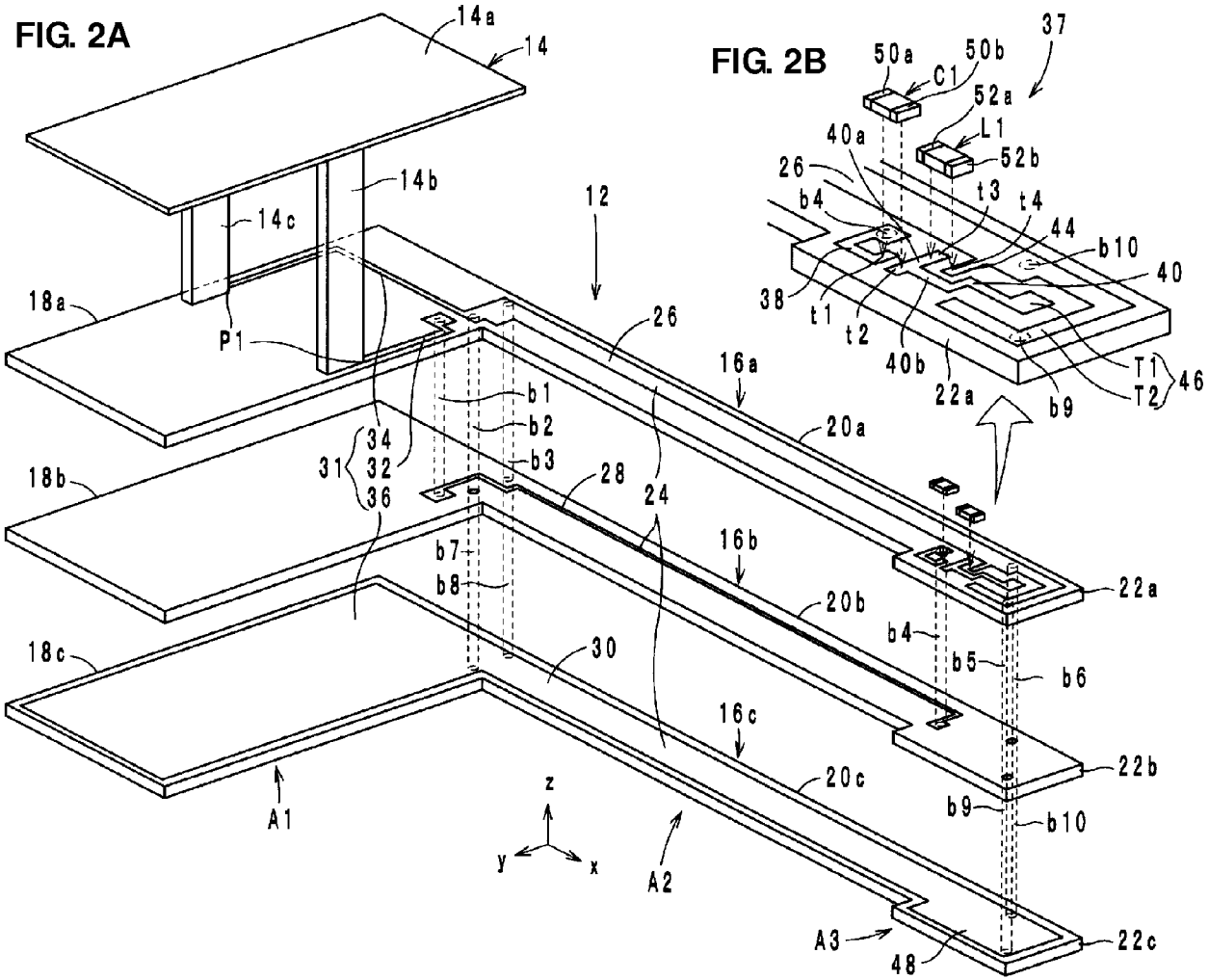
FIG. 2A is an exploded view of the antenna module shown in FIG. 1
FIG. 2B is an enlarged view of an insulating sheet of the antenna module.
Figure 3:
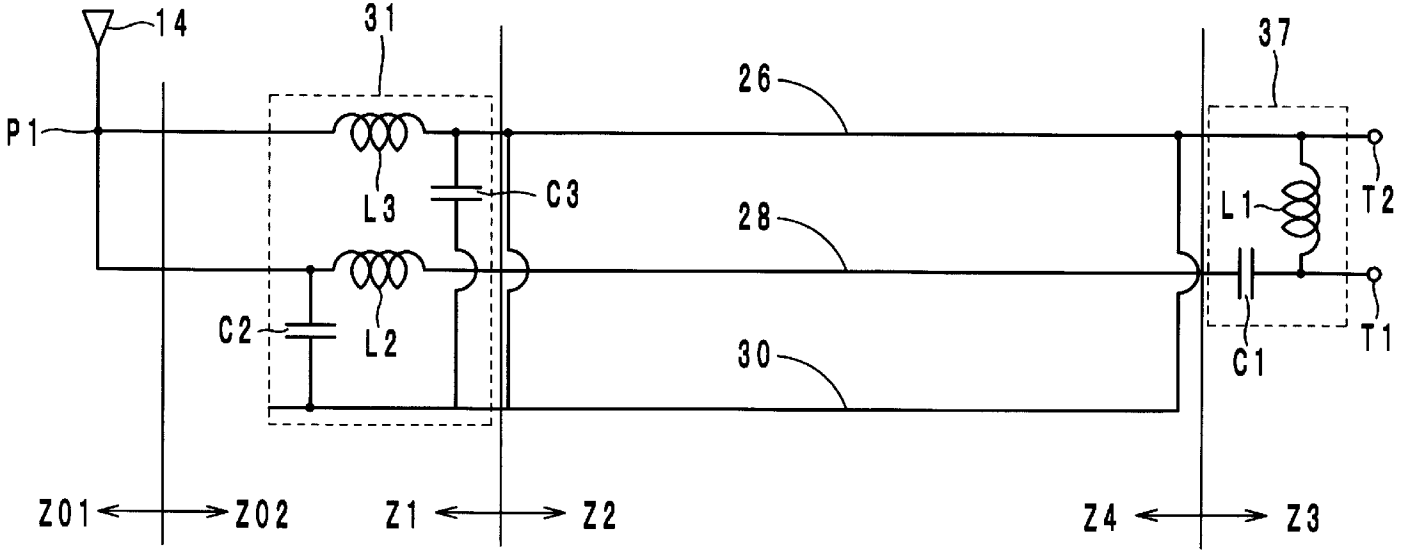
FIG. 3 is an equivalent circuit diagram of the antenna module.
Figure 4:
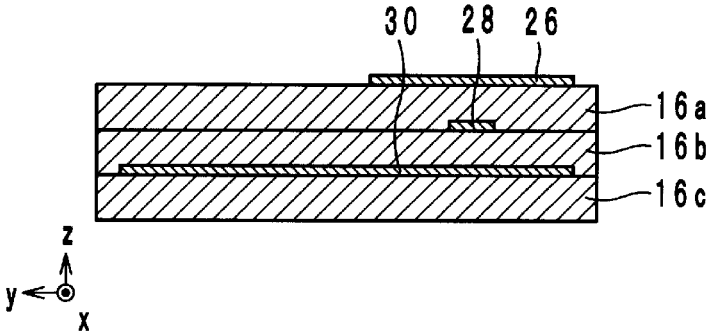
FIG. 4 is a cross-sectional view taken along line A-A of FIG. 1.

A structure of an antenna module according to a preferred embodiment of the present invention is described below with reference to drawings. FIG. 1 is a perspective view illustrating an external appearance of an antenna module 10 according to a preferred embodiment of the present invention. FIG. 2A is an exploded view of the antenna module 10 shown in FIG. 1. FIG. 2B is an enlarged view of an insulating sheet 16*a* of the antenna module 10. FIG. 3 is an equivalent circuit diagram of the antenna module 10. FIG. 4 is a cross-sectional view taken along line A-A of FIG. 1. In FIG. 1 to FIG. 4, a direction of lamination of the antenna module 10 is referred to as a z direction. Furthermore, a lateral direction of the antenna module 10 is referred to as an x direction, and a direction perpendicular to the x and z directions is referred to a y direction.

The antenna module 10 is used, for example, in an electronic device such as a portable telephone or the like, in a state in which the antenna module 10 is folded in half. As shown in FIG. 1 and FIGS. 2A and 2B, the antenna module 10 includes a main portion 12, an antenna 14, a signal transmission line 24, impedance matching circuits 31 and 37, a connection portion 46, a ground conductor 48, and via-hole conductors b1 to b10.

As shown in FIG. 1, the main portion 12 preferably includes the following three regions: an antenna region A1; a signal transmission line region A2; and a connection region A3. As shown in FIG. 1, the signal transmission line region A2 extends in the x direction. The antenna region A1 is located adjacent, in the negative x direction, to the signal transmission line region A2. The antenna region A1 is greater in width in the y direction than the signal transmission line region A2 is. The connection region A3 is located adjacent, in the positive x direction, to the signal transmission line region A2. The connection region A3 is greater in width in the y direction than the signal transmission line region A2. The main portion 12 includes an insulating sheet 16, which is a laminated body including insulating sheets 16*a* to 16*c* stacked in this order from top to bottom in the z direction as shown in FIG. 2.

The insulating sheet 16 preferably is formed of a flexible thermoplastic resin such as a liquid crystal polymer or other suitable material. To ensure that the insulating sheet 16 is flexible, the total thickness of the insulating sheet 16 may be preferably equal to or more than about 10 μm and equal to or less than about 100 μm, for example. As shown in FIG. 2, the insulating sheets 16*a* to 16*c* respectively include antenna portions 18*a* to 18*c*, signal transmission line portions 20*a* to 20*c*, and connection portions 22*a* to 22*c*. The antenna portion 18 defines the antenna region A1 of the main portion 12. The signal transmission line portion 20 defines the signal transmission line region A2 of the main portion 12. The connection portions 22*a* to 22*c* define the connection region A3 of the main portion 12. Hereinafter, a surface of the insulating sheet 16 facing in the positive z direction will be referred to simply as a surface, and a surface facing in the negative z direction will be referred to as a back surface.

The antenna 14 configured to transmit/receive a high-frequency signal (for example, at a frequency of 2 GHz) is located in the antenna region A1 of the main portion 12. The antenna 14 is preferably formed by bending a single metal plate, for example. As shown in FIG. 1 and FIG. 2, the antenna 14 includes a radiation plate 14*a* and fixing portions 14*b* and 14*c*. The radiation plate 14*a* preferably has a rectangular shape that preferably is substantially the same as the shape of the antenna region A1 in plan view seen from the z direction, and is capable of radiating and absorbing a radio wave. The fixing portions 14*b* and 14*c* are connected to middle points of two respective long sides of the radiation plate 14*a* and are bent into the negative z direction. As shown in FIG. 2, the fixing portions 14*b* and 14*c* extends in the z direction, and each end thereof facing in the negative z direction is connected to a surface of the antenna portion 18*a*.

The connection portion 46 includes connection conductors T1 and T2. The connection conductors T1 and T2 are connected to an electronic device (not shown) that outputs/inputs a high-frequency signal. The electronic device may be a circuit element in a high-frequency signal processing circuit. The connection conductor T1 preferably has a square shape and is disposed on a surface of the connection portion 22*a*. The connection conductor T2 is disposed on a surface of the connection portion 22*a* such that the connection conductor T2 is spaced apart from the connection conductor T1 and such that the connection conductor T2 extends around three sides (a side facing in the positive y direction, a side facing in the negative y direction, and a side facing in the positive x direction) of the connection conductor T1. The connection conductors T1 and T2 are connected to an RF connector (not shown), as the electronic device, including an outer conductor and a center conductor. The connection conductor T1 is connected to the center conductor, and the connection conductor T2 is connected to the outer conductor. Via a coaxial cable or the like, the RF connector is connected to an external circuit (not shown) that processes the high-frequency signal. The RF connector, the external circuit, and the coaxial cable or the like define a processing circuit.

The signal transmission line 24 preferably has a strip line structure and is disposed in the signal transmission line region A2 of the main portion 12 such that the high-frequency signal is transmitted along the signal transmission line 24. More specifically, the signal transmission line 24 includes a center conductor 28 and ground conductors 26 and 30. The center conductor 28 is a line-shaped conductive layer disposed on the surface of the signal transmission line portion 20*b* such that the center conductor 28 extends in the x direction. The high-frequency signal propagates along the center conductor 28. One end of the center conductor 28 is located in the antenna region A1 while the other end is located in the connection region A3.

As shown in FIG. 2, the ground conductor 26 is disposed in the signal transmission line region A2 of the main portion 12 such that the ground conductor 26 is at a location shifted from the location of the center conductor 28 in the positive z direction. More specifically, the ground conductor 26 is disposed on the surface of the signal transmission line portion 20*a* such that the ground conductor 26 extends in the x direction. As shown in FIG. 4, the ground conductor 26 has a greater line width in the y direction than that of the center conductor 28. In plan view seen from the z direction, the ground conductor 26 overlaps the center conductor 28. One end of the ground conductor 26 is located in the antenna region A1 and the other end is located in the connection region A3. The end of the ground conductor 26 facing in the positive x direction is connected to the connection conductor T2.

As shown in FIG. 2, the ground conductor 30 is at a location shifted from the location the center conductor 28 in the negative z direction in the signal transmission line region A2 of the main portion 12. More specifically, the ground conductor 30 is disposed on the surface of the signal transmission line portion 20*c* such that the ground conductor 30 extends in the x direction. As shown in FIG. 4, the ground conductor 30 has a greater line width in the y direction than that of the center conductor 28 and the ground conductor 26. In plan view seen from the z direction, the ground conductor 30 overlaps the center conductor 28. Thus, the center conductor 28 and the ground conductors 26 and 30 define the strip line structure as shown in FIG. 4.

The impedance matching circuit 31 is disposed in the antenna region A1 of the main portion 12 and between the antenna 14 and the end of the signal transmission line 24 in the negative x direction. As shown in FIG. 2, the impedance matching circuit 31 includes line-shaped conductors 32 and 34 and a ground conductor 36.

The antenna 14 is connected to the impedance matching circuit 31 via antenna ports P1. A signal port of the antenna ports P1 serves as a connection node between the line-shaped conductor 32 and the fixing portion 14*b*. A ground port of the antenna ports P1 serves as a connection node between the line-shaped conductor 34 and the fixing portion 14*c*.

The line-shaped conductor 32 is a line-shaped conductive layer disposed on the surface of the antenna portion 18*a* such that the line-shaped conductor 32 extends in the x direction. In a plan view seen from the z direction, an end of the line-shaped conductor 32 facing in the negative y direction overlaps the end of the center conductor 28 facing in the negative x direction. The via-hole conductor b1 extends completely through the antenna portion 18*a* in the z direction such that the end of the line-shaped conductor 32 facing in the negative y direction is connected to the end of the center conductor 28 facing in the negative x direction via the via-hole conductor b1. The end of the line-shaped conductor 32 facing in the positive y direction is connected to the fixing portion 14*b* of the antenna 14. The line-shaped conductor 32 has a relatively small line width substantially equal to the line width of the center conductor 28. Thus, as shown in FIG. 3, the line-shaped conductor 32 defines a coil L2 between the center conductor 28 and the antenna 14.

The line-shaped conductor 34 preferably is a line-shaped conductive layer disposed on the surface of the antenna portion 18*a* such that the line-shaped conductor 34 extends in the x direction and is bent, at the end facing in the negative x direction, toward the positive y direction into an L-shape. The end of line-shaped conductor 34 facing in the positive x direction is connected to the ground conductor 26. The end of the line-shaped conductor 34 facing in the positive y direction is connected to the fixing portion 14*c* of the antenna 14. The line-shaped conductor 34 has a relatively small line width substantially equal to the line width of the center conductor 28. Thus, as shown in FIG. 3, the line-shaped conductor 34 defines a coil L3 between the ground conductor 26 and the antenna 14.

The ground conductor 36 is arranged such that substantially the whole surface of the antenna portion 18*c* is covered with the ground conductor 36 and the ground conductor 36 is connected to the end of ground conductor 30 facing in the negative x direction. This makes it possible to prevent the antenna region A1 of the main portion 12 from being easily deformed. In plan view seen from the z direction, the line-shaped conductors 32 and 34 overlap the ground conductor 36. As a result, the line-shaped conductor 32 and 34 and the ground conductor 36 define the strip line structure. In this structure, capacitance C2 occurs between the line-shaped conductor 32 and the ground conductor 36 as shown in FIG. 3. Furthermore, capacitance C3 occurs between the line-shaped conductor 34 and the ground conductor 36 as shown in FIG. 3.

Note that because the line-shaped conductor 34 is electrically connected to the ground conductor 36, the capacitor C3 is charged by a much smaller amount of electric charge than the capacitor C2 is charged. More specifically, in a plan view seen from the z direction, the end of the ground conductor 26 facing in the negative x direction overlaps the ground conductor 36. The via-hole conductors b2 and b7 respectively extend completely through the antenna portions 18*a* and 18*b* in the z direction and are connected to each other such that the end of the ground conductor 26 facing in the negative x direction and the ground conductor 36 are connected to each other via the via-hole conductors b2 and b7. Similarly, the via-hole conductors b3 and b8 respectively extend completely through the antenna portions 18*a* and 18*b* in the z direction and are connected to each other such that the end of the ground conductor 26 facing in the negative x direction and the ground conductor 36 are connected to each other via the via-hole conductors b3 and b8. As a result, the line-shaped conductor 34 is connected to the ground conductor 36 via the ground conductor 26. Thus, the line-shaped conductor 34 is applied with the ground potential as with the ground conductor 36, and thus the capacitor C3 between the line-shaped conductor 34 and the ground conductor 36 is charged by a much smaller amount of electric charge than that of the capacitor C2.

As described above, the impedance matching circuit 31 preferably includes a lowpass filter including a combination of the coils L2 and L3 and the capacitors C2 and C3. The impedance matching circuit 31 provides impedance matching between an impedance Z1 of the antenna 14 seen from the end of signal transmission line 24 facing in the negative x direction (see FIG. 3) and an impedance Z2 of the signal transmission line 24 seen from the end of the signal transmission line 24 facing in the negative x direction (see FIG. 3). The line-shaped conductor 34 of the impedance matching circuit 31 is designed such that the impedance Z1 and the impedance Z2 are conjugate with each other. The situation in that the impedance Z1 and the impedance Z2 are conjugate with each other is when the impedance Z1 is "a+jb", the impedance Z2 is "a−jb". As a result, the generation of power loss between the antenna 14 and the signal transmission line 24 can be reduced.

The impedance matching circuit 37 is disposed in the connection region A3 of the main portion 12 and between the connection portion 46 and the end of the signal transmission line 24 facing in the positive x direction. As shown in FIG. 2, the impedance matching circuit 37 preferably includes a chip capacitor C1, a chip coil L1, and line-shaped conductors 38, 40, and 44, for example.

The line-shaped conductor 38 preferably is a line-shaped conductive layer disposed on the surface of the connection portion 22*a*. In plan view seen from the z direction, one end of the line-shaped conductor 38 overlaps the end of the center conductor 28 facing in the positive x direction. The via-hole conductor b4 extends completely through the connection portion 22*a* in the z direction such that the one end of the line-shaped conductor 38 is connected to the end of the center conductor 28 facing in the positive x direction via the via-hole conductor b4. A connection conductor t1 is disposed on the other end of the line-shaped conductor 38.

The line-shaped conductor 40 preferably is a line-shaped conductive layer disposed on the surface of the connection portion 22*a* such that it extends along a path preferably having a T-shaped configuration. More specifically, the line-shaped conductor 40 includes line-shaped conductors 40*a* and 40*b*. As shown in FIG. 2, the line-shaped conductor 40*a* is a line-shaped conductive layer extending in the y direction. A connection conductor t2 is disposed on an end of the line-shaped conductor 40*a* facing in the positive y direction. A connection conductor t3 is disposed on an end of the line-shaped conductor 40*b* facing in the negative y direction. The line-shaped conductor 40*b* extends in the positive x direction from a substantially central point of the line-shaped conductor 40*a*. The end, facing in the positive x direction, of the line-shaped conductor 40*b* is connected to the connection conductor T1.

The line-shaped conductor 44 is a line-shaped conductive layer that is disposed on the surface of the connection portion 22*a* such that the line-shaped conductor 44 projects from the ground conductor 26 in the positive y direction. A connection conductor t4 is disposed on the end of the line-shaped conductor 44 facing in the positive y direction.

The chip capacitor C1 is, for example, a laminated-type electronic component including a capacitor, and the chip capacitor C1 includes external electrodes 50*a* and 50*b*. The chip capacitor C1 is mounted on the connection portion 22*a* by soldering such that the external electrode 50*a* is connected to the connection conductor t1 and the external electrode 50*b* is connected to the connection conductor t2. The line-shaped conductor 38 is electrically connected to the center conductor 28 via the via-hole conductor b4. As a result, the chip capacitor C1 is connected between the center conductor 28 and the connection conductor T1 as shown in FIG. 3.

The chip coil L1 is, for example, a laminated-type electronic component including a coil, and the chip coil L1 includes external electrodes 52*a* and 52*b*. The chip coil L1 is mounted on the connection portion 22*a* by soldering such that the external electrode 52*a* is connected to the connection conductor t3, and the external electrode 52*b* is connected to the connection conductor t4. The line-shaped conductor 44 is connected to the connection conductor T2 via the ground conductor 26. As a result, as shown in FIG. 3, the chip coil L1 is connected between the connection conductor T1 and the connection conductor T2.

As described above, the impedance matching circuit 37 preferably includes a highpass filter including a combination of the chip coil L1 and the chip capacitor C1, for example. The impedance matching circuit 37 provides impedance matching between an impedance Z3 of the connection portion 46, in a state in which the electronic device is connected to the connection portion 46, seen from the end of the signal transmission line 24 facing in the positive x direction (see FIG. 3) and an impedance Z4 of the signal transmission line 24 seen from the end of the signal transmission line 24 facing in the positive x direction (see FIG. 3). The chip coil L1 and the chip capacitor C1 of the impedance matching circuit 37 are selected such that the impedance Z3 and the impedance Z4 are conjugated with each other. This results in a reduction in power loss between the electronic device and the signal transmission line 24.

The ground conductor 48 is configured such that substantially the entire surface of the connection portion 22*c* is covered with the ground conductor 48 and the ground conductor 48 is connected to the end of the ground conductor 30 facing in the positive x direction. This makes it possible to prevent the connection region A3 of the main portion 12 from being easily deformed. In plan view seen from the z direction, the connection conductor T2 and the end of the ground conductor 26 facing in the positive x direction overlap the ground conductor 48. The via-hole conductors b5 and b9 extend completely through the connection portions 22*a* and 22*b* in the z direction and are connected to each other such that the end of the ground conductor 26 facing in the positive x direction and the ground conductor 48 are connected to each other via the via-hole conductors b5 and b9. Similarly, the via-hole conductors b6 and b10 extend completely through the connection portions 22*a* and 22*b* in the z direction and are connected to each other such that the connection conductor T2 and the ground conductor 48 are connected to each other via the via-hole conductors b6 and b10.

Next, a description of the characteristic impedances of the antenna 14, the signal transmission line 24, and the electronic device is provided. The antenna 14 has a characteristic impedance Z11 (for example, 377 ohms) to radiate radio wave into the air or absorb a radio wave from the air. The electronic device is, for example, an RF connector configured to be connected to a coaxial cable with a characteristic impedance of 50 ohms or 75 ohms, and thus the electronic device has a characteristic impedance Z12 (for example, 50 ohms or 75 ohms) equal to the characteristic impedance of the coaxial cable. The signal transmission line 24 has a characteristic impedance Z13 (for example, 30 ohms) smaller than the characteristic impedances Z11 and Z12. The impedance Z01 of the antenna 14 seen from the antenna port P1 and the impedance Z02 of the impedance matching circuit 31 seen from the antenna port P1 are usually in a range from 1 ohms to 25 ohms. That is, the characteristic impedance Z0 of the antenna port P1 is usually in the range from 1 ohms to 25 ohms. Thus, the antenna module 10 includes the impedance matching circuits 31 and 37 to prevent reflection of a high-frequency signal at the boundary between the antenna 14 and the signal transmission line 24 and at the boundary between the signal transmission line 24 and the connection portion 46. This makes it possible to achieve a stable characteristic impedance at the connection portion 46 side even when the signal transmission line 24 is bent with a small radius.

The characteristic impedance of the antenna port P1 is smaller than the characteristic impedance of the signal transmission line 24 and the characteristic impedance of the electronic device connected to the connection conductors T1 and T2 of the connection portion 46. Because the characteristic impedance changes stepwisely from the antenna port P1 to the connection portion 46, the loss due to impedance conversion is minimized.

A non-limiting example of a method of producing the antenna module 10 is described below with reference to drawings. In the following description, it is assumed by way of example that a single antenna module 10 is produced. Note that in a practical production process, a plurality of antenna modules 10 may be produced simultaneously by laminating large-sized insulating sheets and cutting a resultant laminated sheet into a plurality of pieces.

First, an insulating sheet 16 is prepared such that the insulating sheet 16 is formed of a thermoplastic resin such as a liquid crystal polymer or the like whose surface is entirely covered with a copper film. Next, using a photolithography process, the ground conductor 26, the line-shaped conductors 32, 34, 38, 40, and 44, and the connection conductors T1 and T2, shown in FIG. 2, are formed on the surface of the insulating sheet 16*a*. More specifically, a resist is printed on the copper film of the insulating sheet 16*a* such that the resist has the same pattern of the ground conductor 26, the line-shaped conductors 32, 34, 38, 40, and 44, and the connection conductors T1 and T2, shown in FIG. 2. Thereafter, the copper film is etched such that a portion of the copper film exposed without being covered by the resist is removed. The resist is then removed. As a result, as shown in FIG. 2, the ground conductor 26, the line-shaped conductors 32, 34, 38, 40, and 44, and the connection conductors T1 and T2 are formed on the surface of the insulating sheet 16*a*.

Next, a further photolithography process is performed to form the center conductor 28 shown in FIG. 2 on the surface of the insulating sheet 16*b*. Furthermore, a photolithography process is performed to form the ground conductors 30, 36, and 48 shown in FIG. 2 on the surface of the insulating sheet 16*c*. These photolithography processes are similar to the photolithography process performed to form the ground conductor 26, the line-shaped conductors 32, 34, 38, 40, and 44, and the connection conductors T1 and T2, and thus a further detailed description thereof is omitted.

Next, the insulating sheets 16*a* and 16*b* are irradiated with a laser beam from the back side thereof such that the laser beam hits areas where the via-hole conductors b1 to b10 are to be formed thereby to form the via-holes. Thereafter, the via-holes formed in the insulating sheets 16*a* and 16*b* are filled with conductive paste containing copper as a main ingredient to form the via-hole conductors b1 to b10 as shown in FIG. 2.

Next, the insulating sheets 16*a* to 16*c* are put one on another in this order. The insulating sheets 16*a* to 16*c* are then pressure-bonded by applying force thereto isotropically or via an elastic material from the positive and negative z directions. Finally, the antenna 14 is soldered to the antenna region A1. Thus, the antenna module 10 shown in FIG. 1 is obtained.

The antenna module 10 is configured such that the signal transmission line region A2 of the main portion 12 is capable of being bent with a small radius while maintaining the stability of the characteristic impedance without resulting in an increase in DC resistance. In contrast, for example, in the case of the strip line cable 500 disclosed in Japanese Unexamined Patent Application Publication No. 8-242117, the rigidity of the strip line cable 500 is reduced by reducing the thickness of the insulators 510 and 512 to make it possible to bend the transmission line part 504 with a small radius.

However, in the strip line cable 500, the reduction in the thickness of the insulators 510 and 512 results in a reduction in the distance between the center conductor 514 and the conductors 516 and 518, which leads to an increase in capacitance between the center conductor 514 and the conductors 516 and 518. Therefore, the capacitance between the center conductor 514 and the conductors 516, 518 becomes large, and the characteristic impedance of the strip line of the transmission line part 504 is shifted from the predetermined characteristic impedance (for example, 50 ohms or 75 ohms). To prevent the shift in the characteristic impedance, it is necessary to reduce the line width of the center conductor 514 to reduce the capacitance between the center conductor 514 and the conductors 516 and 518. However, the reduction in the line width of the center conductor 514 results in an increase in DC resistance of the strip line cable 500.

In view of the above, the antenna module 10 according to a preferred embodiment of the present invention preferably is configured such that the impedance matching circuit 31 is disposed between the antenna 14 and the end of the signal transmission line 24 facing in the negative x direction. The impedance matching circuit 31 provides impedance matching between the impedance Z1 of the antenna 14 seen from the end of the signal transmission line 24 facing in the negative x direction and the impedance Z2 of the signal transmission line 24 seen from the end of the signal transmission line 24 facing in the negative x direction. Furthermore, the impedance matching circuit 37 is disposed between the connection portion 46 and the end of the signal transmission line 24 facing in the positive x direction. The impedance matching circuit 37 provides impedance matching between the impedance Z3 of the connection portion 46, in a state in which the electronic device is connected to the connection portion 46, seen from the end of the signal transmission line 24 facing in the positive x direction and the impedance Z4 of the signal transmission line 24 seen from the end of the signal transmission line 24 facing in the positive x direction. By providing the impedance matching circuits 31 and 37 at respective ends of the signal transmission line 24 in the above-described manner, it becomes possible to achieve impedance matching among the signal transmission line 24, the antenna 14, and the electronic device even in a state in which the characteristic impedance Z13 of the signal transmission line 24 is different from the characteristic impedance Z11 of the antenna 14 and the characteristic impedance Z12 of the electronic device. Thus, it is possible to reduce the thickness of the main portion 12 without causing degradation in impedance matching among the signal transmission line 24, the antenna 14, and the electronic device. This makes it unnecessary to reduce the width of the center conductor 28 when the thickness of the main portion 12 is reduced. Thus, in the antenna module 10 configured in above-described manner, the signal transmission line region A2 of the main portion 12 can be bent with a small radius while maintaining the stability in the characteristic impedance without causing an increase in DC resistance.

Furthermore, in the antenna module 10, it is possible to reduce the DC resistance as described below. In the antenna module 10, the characteristic impedance Z13 of the signal transmission line 24 is allowed to be different from the characteristic impedance Z11 of the antenna 14 and the characteristic impedance Z12 of the electronic device. This makes it possible to increase the line width of the center conductor 28 of the signal transmission line 24. Thus, in this antenna module 10, the center conductor 28 has a small DC resistance, which allows a reduction in loss of a high-frequency signal.

Furthermore, the antenna module 10 can be used with many types of electronic devices without performing redesign and thus high versatility is achieved as described below. The electronic device is, for example, an RF connector having a characteristic impedance (for example, 50 ohms or 75 ohms). In the antenna module 10, the impedance matching circuit 37 is disposed between the connection portion 46 and the end of the signal transmission line 24 facing in the positive x direction. The impedance matching circuit 37 provides impedance matching between the impedance Z3 of the connection portion 46, in a state in which the electronic device is connected to the connection portion 46, seen from the end of the signal transmission line 24 facing in the positive x direction and the impedance Z4 of the signal transmission line 24 seen from the end of the signal transmission line 24 facing in the positive x direction. That is, the impedance matching circuit 37 is designed such that impedance matching is achieved when an electronic device having a particular impedance is connected to the connection portion 46. This makes it possible to achieve impedance matching among the signal transmission line 24, the antenna 14, and the electronic device regardless of the type of the electronic device. Thus, the antenna module 10 can be used in various types of electronic devices without needing redesign.

Figure 5:
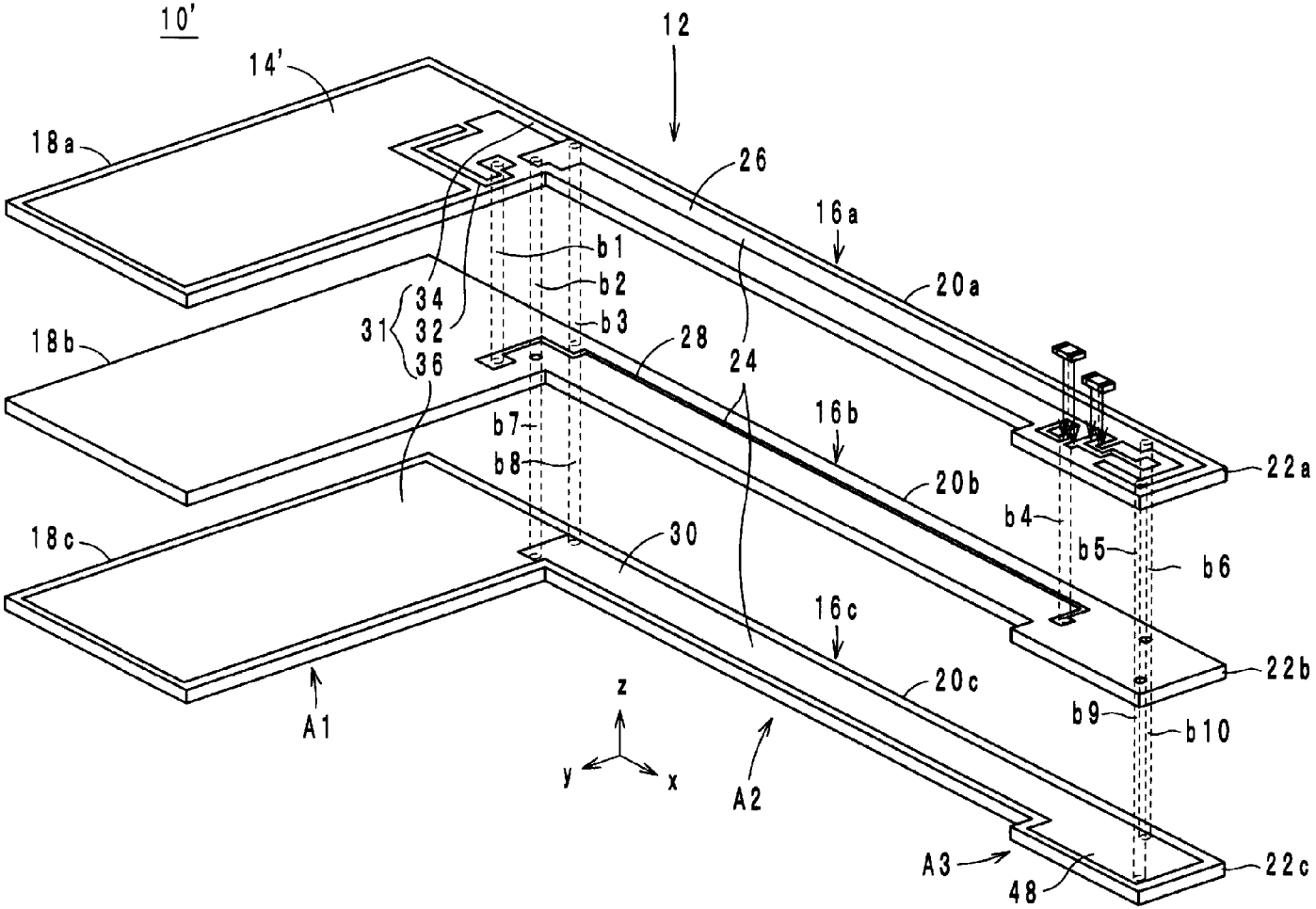
FIG. 5 is an exploded perspective view of an antenna module according to a modified preferred embodiment of the present invention.
Figure 6:
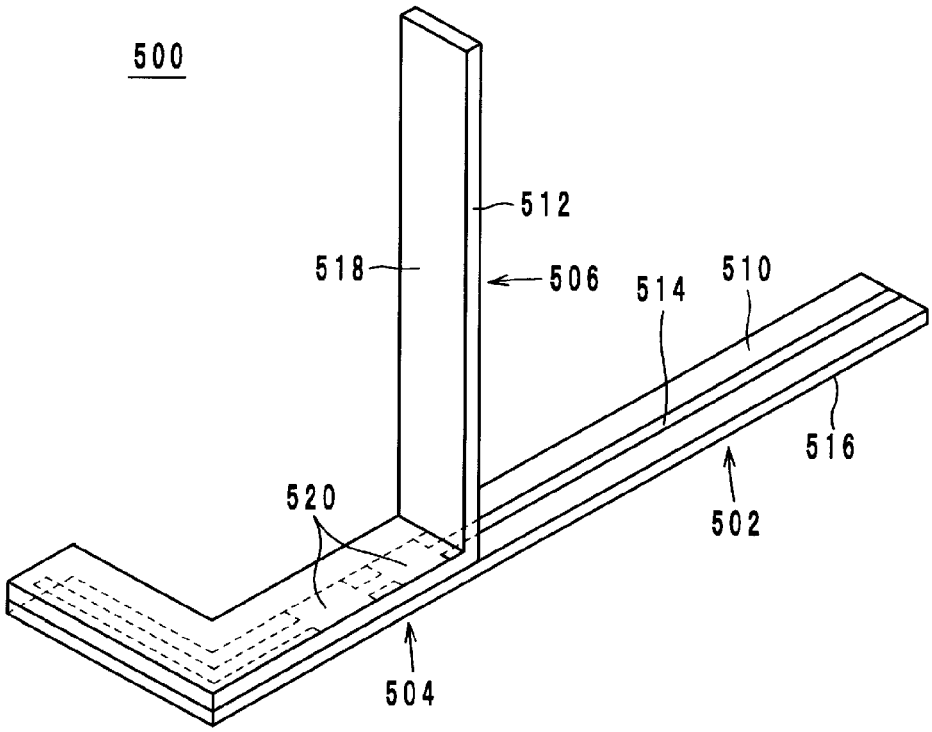
FIG. 6 PRIOR ART
FIG. 6 is a perspective view illustrating an external appearance of a strip line cable integrated with an antenna disclosed in Japanese Unexamined Patent Application Publication No. 8-242117.

An antenna module according to a modified preferred embodiment is described below with reference to drawings. FIG. 5 is an exploded perspective view of an antenna module 10' according to a modified preferred embodiment. In FIG. 5, similar elements to those shown in FIG. 2 are denoted by similar reference numerals.

The antenna module 10' is different from the antenna module 10 in that the antenna 14' has a structure different from that of the antenna 14. More specifically, in the antenna module 10, the antenna 14 is preferably produced by bending a metal plate and is attached to the antenna region A1. In contrast, the antenna 14' is disposed on the surface of the antenna portion 18*a*. More specifically, the antenna 14' is disposed on the surface on the antenna portion 18*a* using a copper film using a process similar to that used to form the ground conductor 26, the line-shaped conductors 32, 34, 38, 40, and 44, and the connection conductors T1, and T2. The other elements of the antenna module 10' preferably are similar to those of the antenna module 10 and thus a further detailed description thereof is omitted.

In the antenna modules 10 and 10', the impedance matching circuit 37 preferably includes a chip coil L1 and a chip capacitor C1. Note that the impedance matching circuit 37 may include line-shaped conductors and ground conductors disposed in the connection portions 22*a* to 22*c*.

In the antenna modules 10 and 10', the impedance matching circuit 31 preferably includes the line-shaped conductors 32 and 34 and the ground conductor 36. Alternatively, the impedance matching circuit 31 may preferably include a chip coil and a chip capacitor.

In the antenna modules 10 and 10', the electronic device mounted on the connection portion 46 is an RF connector. Alternatively, the electronic device may be another type of electronic component such as an IC chip.

The signal transmission line 24 preferably has a strip line structure. Alternatively, the signal transmission line 24 may have a microstrip line structure.

Various preferred embodiments of the present invention are useful, in particular, when applied to an antenna module. More specifically, preferred embodiments of the present invention are excellent in that a signal transmission line is capable of being bent with a radius while maintaining stability in the characteristic impedance without resulting in an increase in DC resistance.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An antenna module comprising:

a main portion including a lamination of a plurality of flexible insulating sheets, the main portion including an antenna region, a signal transmission line region, and a connection region;

an antenna disposed on the main portion in the antenna region and configured to transmit/receive a high-frequency signal;

a connection portion disposed on the main portion in the connection region and configured to be connected to an electronic device that outputs/inputs the high-frequency signal;

a signal transmission line configured to transmit the high-frequency signal, the signal transmission line being disposed in the main portion in the signal transmission line region and having a strip line structure or a microstrip line structure;

a first impedance matching circuit disposed in the antenna region; and a second impedance matching circuit disposed in the connection region; wherein the plurality of flexible insulating sheets include and define the antenna region, the signal transmission line region, and the connection region;

no impedance matching circuits are disposed in the signal transmission line region;

the antenna region, the signal transmission line region, and the connection region are arranged in this order along a longitudinal direction of the main portion;

a width of the signal transmission line region extending in a direction perpendicular or substantially perpendicular to the longitudinal direction is less than a width of the antenna region extending in the direction perpendicular or substantially perpendicular to the longitudinal direction and is less than a width of the connection region extending in the direction perpendicular or substantially perpendicular to the longitudinal direction;

the first impedance matching circuit includes a line-shaped conductor and a ground conductor, and does not include any chip elements; and the second impedance matching circuit includes at least one of a chip capacitor and a chip coil.

2. The antenna module according to claim 1, wherein the electronic device has a first characteristic impedance, and the signal transmission line has a second characteristic impedance smaller than the first characteristic impedance.

3. The antenna module according to claim 2, wherein an antenna port defining a connection port between the antenna and the first impedance matching circuit has a characteristic impedance smaller than the first characteristic impedance and the second characteristic impedance.

4. The antenna module according to claim 1, wherein the first impedance matching circuit provides impedance matching between a first impedance of the antenna seen from one end of the signal transmission line and a second impedance of the signal transmission line seen from the one end of the signal transmission line; and the second impedance matching circuit provides impedance matching between a third impedance of the connection portion in a state in which the electronic device is connected to the connection portion seen from the other end of the signal transmission line and a fourth impedance of the signal transmission line seen from the other end of the signal transmission line.

5. The antenna module according to claim 4, wherein the first impedance and the second impedance are conjugate with each other, and the third impedance and the fourth impedance are conjugate with each other.

6. The antenna module according to claim 1, wherein each of the insulating sheets has a thickness equal to or more than about 10 μm and equal to or less than about 100 μm.

7. The antenna module according to claim 1, further comprising:

a first ground conductor disposed on one of the plurality of flexible insulating sheets;

a second ground conductor disposed on another one of the plurality of flexible insulating sheets; and at least one via-hole conductor extending in a lamination direction of the plurality of flexible insulating sheets and connecting the first ground conductor to the second ground conductor; wherein the signal transmission line region of the main portion does not contain any of the at least one via-hole conductor.

* * * * *